US005778278A

United States Patent [19]

Jeon

[11] Patent Number: 5,778,278

[45] Date of Patent: Jul. 7, 1998

[54] DEVICE FOR PREVENTING FIXING UNIT FROM OVERHEATING IN AN ELECTROPHOTOGRAPHIC SYSTEM

[75] Inventor: Nam-Gon Jeon, Seoul, Rep. of Korea

[73] Assignee: SamSung Electronics Co., Ltd., Suwon, Rep. of Korea

[21] Appl. No.: 667,921

[22] Filed: Jun. 20, 1996

[30] Foreign Application Priority Data

Jun. 20, 1995 [KR] Rep. of Korea ..... 1995-13969

[51] Int. Cl.[6] ..... G03G 15/20

[52] U.S. Cl. ..... 399/33; 399/330; 399/331

[58] Field of Search ..... 355/282, 285, 355/290, 295; 399/33, 330, 331

[56] References Cited

U.S. PATENT DOCUMENTS

| | | | |
|---|---|---|---|
| 4,541,708 | 9/1985 | Shigenobu | 355/285 X |
| 5,212,528 | 5/1993 | Matsuda | 355/285 |
| 5,235,393 | 8/1993 | Merle | 355/282 |
| 5,247,336 | 9/1993 | Mills, III | 355/285 |
| 5,325,166 | 6/1994 | Hamilton et al. | 355/285 |
| 5,329,342 | 7/1994 | Shirai et al. | 355/285 |
| 5,432,593 | 7/1995 | Nishikawa et al. | 355/290 |
| 5,486,908 | 1/1996 | Miyamoto et al. | 355/290 |

FOREIGN PATENT DOCUMENTS

| | | |
|---|---|---|
| 63-159890 | 7/1988 | Japan . |
| 6-289744 | 10/1994 | Japan . |

*Primary Examiner*—Nestor Ramirez
*Attorney, Agent, or Firm*—Robert E. Bushnell, Esq.

[57] ABSTRACT

A device for preventing a fixing unit from overheating in an electrophotographic system includes a heating lamp positioned within an interior portion of the heat roller for generating heat to increase a temperature exhibited by the heat roller. A frame supports a bearing of the heat roller. A thermal sensor is formed on one side of the frame and contacts a surface of the heat roller to control the temperature exhibited by the heat roller. A thermal fuse interrupts electrical power to the heating lamp upon detecting that the temperature exhibited by the heat roller exceeds a predetermined level. A pressure roller applies a force upon the heat roller so that the heat roller is displaced in a direction towards the thermal fuse as a recording sheet passes between the heat roller and the pressure roller.

18 Claims, 2 Drawing Sheets

DEVICE FOR PREVENTING FIXING UNIT FROM OVERHEATING IN AN ELECTROPHOTOGRAPHIC SYSTEM

CLAIM FOR PRIORITY

This application makes reference to, incorporates the same herein, and claims all benefits accruing under 35 U.S.C. §119 arising from an application for Device For Preventing Fixing Unit From Overheating In An Electrophotographic System earlier filed in the Korean Industrial Property Office on 20 Jun. 1995 and there duly assigned Ser. No. 13969/1995.

BACKGROUND OF THE INVENTION

The present invention generally relates to electrophotographic systems, and more particularly, to a device for preventing a fixing unit from overheating in an electrophotographic system, such as a laser printer, copier, facsimile machine, and image formation apparatus generally.

In a typical electrophotographic system, the surface of an electrostatically charged photosensitive drum is exposed to image carrying light to form an electrostatic latent image. Toner is applied to this electrostatic latent image for development, and the toner image is transferred to a recording sheet, such as paper, and fixed thereon.

The toner fixing operation is commonly conducted using a fixing unit comprised of a heat roller and a pressure roller. As the recording sheet passes between the heat roller and pressure roller, a combination of heat and pressure fix the toner image upon the surface of the recording sheet. One problem that arises in this operation is overheating of the fixing unit. This problem is particularly troublesome since, if this overheated condition exists for too long, internal system components can begin to soften and melt. Accordingly, the need for preventing an overheated condition of the fixing unit is a major concern.

One prior art reference that addresses this issue is U.S. Pat. No. 5,212,528 entitled Fixing Device And Method Which Uses A Heat Dissipating Roller Having Fins issued to Matsuda. In Matsuda '528, a heat dissipation roller is placed in contact with a pressure roller to eliminate excess heat. The heat dissipation roller has a substantially hollow interior for the passage of circulating cooling air. While this approach is useful in its own right for preventing an overheated condition, I note that it requires use of the specially designed heat dissipation roller which increases the cost of the system.

SUMMARY OF THE INVENTION

Therefore, it is an object of the present invention to provide an improved and cost effective configuration for preventing a fixing unit from overheating in an electrophotographic system.

It is another object to provide a device capable of reducing the amount of time required to interrupt electrical power provided to a heating lamp upon detection of an overheated condition of a fixing unit.

It is still another object to provide a device for preventing damage to an electrophotographic system by promptly reacting to an overheated condition of a fixing unit.

It is yet another object to provide a device for preventing a fixing unit from overheating by moving a heat roller in a direction towards a thermal fuse.

To achieve these and other objects, the present invention provides a device for preventing a fixing unit from overheating in an electrophotographic system. The device includes a heating lamp positioned within an interior portion of a heat roller for generating heat to increase a temperature exhibited by the heat roller. A frame supports a bearing of the heat roller. A thermal sensor is formed on one side of the frame and contacts a surface of the heat roller to control the temperature exhibited by the heat roller. A thermal fuse interrupts electrical power to the heating lamp upon detecting that the temperature exhibited by the heat roller exceeds a predetermined level. A pressure roller applies a force upon the heat roller so that the heat roller is displaced in a direction towards the thermal fuse.

BRIEF DESCRIPTION OF THE DRAWINGS

These and various other features and advantages of the present invention will be readily understood with reference to the following detailed description taken in conjunction with the accompanying drawings, in which.

DETAILED DESCRIPTION OF THE INVENTION

Figure 1:
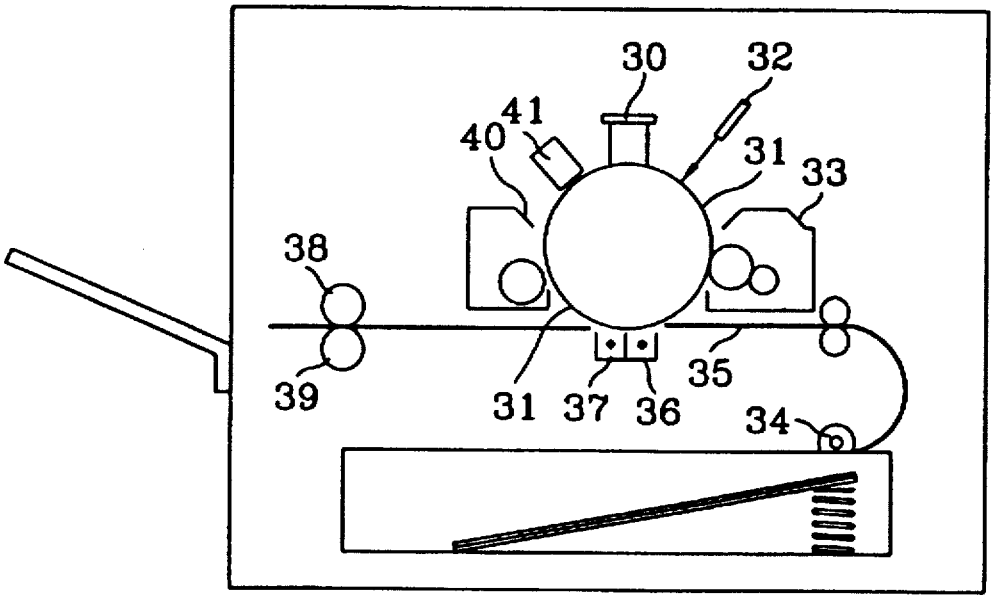
FIG. 1 is a diagram showing an electrophotographic system.

Turning now to the drawings and referring to FIG. 1, a diagram of an electrophotographic system is shown. In FIG. 1, a charger 30 forms a uniform charge layer on an outer surface of a photosensitive drum 31 by a corona discharge. The charged outer surface of photosensitive drum 31 is then exposed to light provided from an exposing unit 32 as photosensitive drum 31 rotates and an electrostatic latent image is thus formed on the exposed outer surface. The electrostatic latent image is developed with toner while passing a developing unit 33 during the rotation of photosensitive drum 31, thereby producing visible images on the outer surface of photosensitive drum 31. The visible images are transferred onto a recording sheet 35 by a transfer unit 36 after recording sheet 35 is fed by a feeding roller 34. Recording sheet 35 closely adheres to photosensitive drum 31 due to an electrostatic force, and a separator 37 separates recording sheet 35 from photosensitive drum 31. Recording sheet 35 is then passed between a heat roller 38 and a pressure roller 39 of a fixing unit, enabling the toner image to become fixed upon recording sheet 35 by the heat and pressure of the fixing unit. Residual toner and the latent image are removed from the surface of photosensitive drum 31 after transfer by a cleaning unit 40 and a latent image erasing lamp 41, respectively.

In the electrophotographic system described above, the fixing unit is of the type in which a thermal sensor and a thermal fuse are arranged to be in and out of contact with the heat roller. The thermal sensor serves to maintain and control the fixing temperature, and the thermal fuse serves to interrupt electrical power provided to a heating lamp if the fixing unit becomes overheated due to breakdown or malfunction of the thermal sensor.

Figure 2:
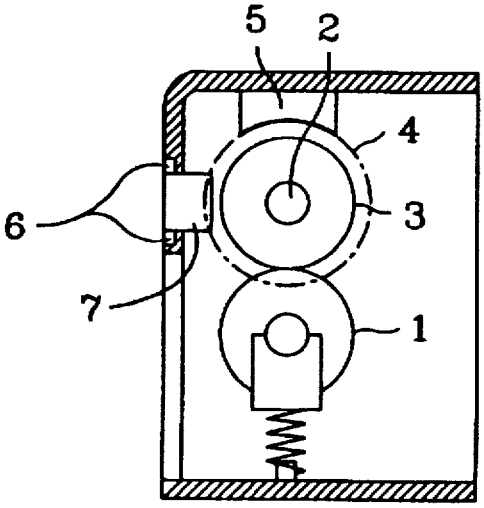
FIG. 2 is a diagram showing a general device for preventing a fixing unit from overheating in an electrophotographic system.

FIG. 2 is a diagram showing a general device for preventing a fixing unit from overheating in an electrophotographic system. In FIG. 2, a heat roller 3 includes heater 2, such as a heating lamp, installed within an interior portion, and is positioned to engage a pressure roller 1. A supporting frame 5 is connected to a bearing 4 of heat roller 3. A thermal fuse 7 is connected to a system power supply and to a current line of heater 2 at a connection unit 6, and is positioned so as not to contact the surface of heat roller 3. Connection unit 6 is formed on both sides of thermal fuse 7.

In FIG. 2, heater 2 generates heat in response to the electrical current provided from the system power supply. This heat radiates from heater 2 and increases the temperature of the inner surface of heat roller 3. The heat continues to radiate through heat roller 3 and eventually increases the temperature of the outer surface of heat roller 3. If the temperature of heat roller 3 increases beyond a predetermined level due to malfunction of a thermal sensor (not shown in FIG. 2), thermal fuse 7 is cut off and the electrical power provided to heater 2 is interrupted, thereby preventing heat roller 3 from overheating. In FIG. 2, however, since thermal fuse 7 is spaced-apart from heat roller 3, a long period of time often elapses before the electrical power to heater 2 is interrupted. As a result, supporting frame 5 may begin to melt, thereby causing significant damage to the system.

Figure 3:
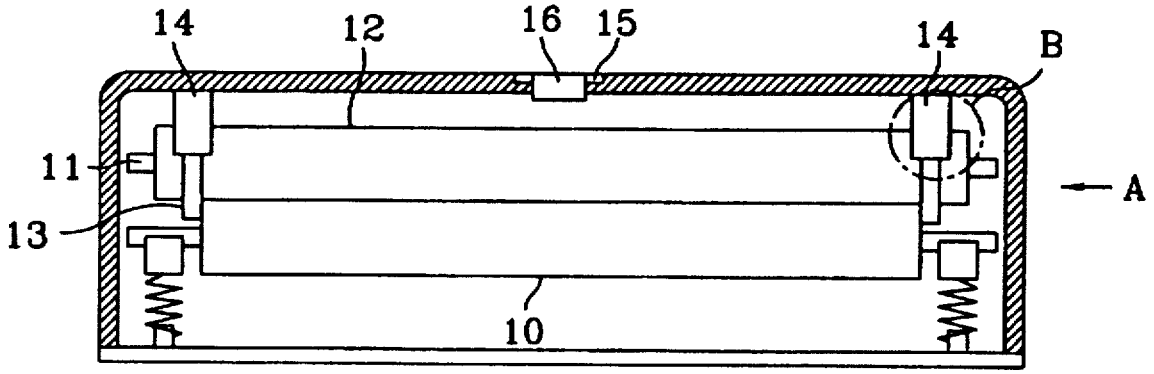
FIG. 3 is a diagram showing a device for preventing a fixing unit from overheating in an electrophotographic system constructed according to the principles of the present invention.
Figure 4:
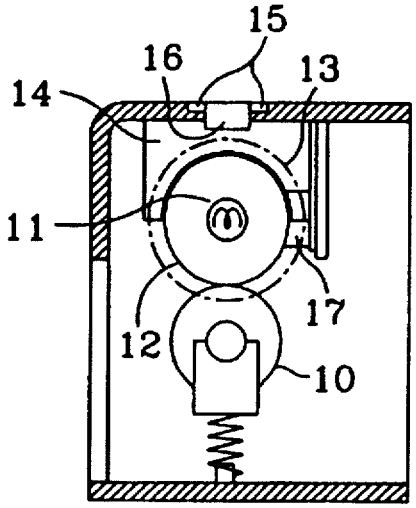
FIG. 4 is a sectional view taken along the sectional line IV–IV' in FIG. 3.
Figure 5:
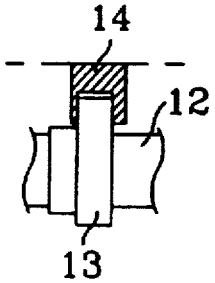
FIG. 5 is a sectional view showing details of portion "B" in FIG. 3.

Referring now to FIGS. 3 through 5, a diagram of a device for preventing a fixing unit from overheating in an electrophotographic system constructed according to the principles of the present invention is shown. In FIGS. 3 through 5, a heat roller 12 includes heater 11, such as a heating lamp, installed within its interior portion, and is positioned to engage a pressure roller 10. A supporting frame 14 is connected to a bearing 13 of heat roller 12. One side of supporting frame 14 is thin and can be easily melted if heat roller 12 overheats. A thermal fuse 16 is positioned at a location such that pressure roller 10 displaces heat roller 12 in a direction towards thermal fuse 16. A connection unit 15 is formed on both sides of thermal fuse 16. A thermal sensor 17 is positioned on one side of supporting frame 14 to contact the surface of heat roller 12, and thus controls the temperature of heat roller 12. Thermal sensor 17 may be constructed using a thermistor or a thermocouple. Thermal fuse 16 is connected to a system power supply and to a current line of heater 11 via connection unit 15.

Heater 11 generates heat in response to the electrical current provided from the system power supply. This heat radiates from heating means 11 and increases the temperature of the inner surface of heat roller 12. The heat continues to radiate through heat roller 12 and eventually increases the temperature of the outer surface of heat roller 12. If the temperature of heat roller 12 increases beyond a predetermined level, thermal sensor 17 senses the overheating of heat roller 12 and controls its temperature by interrupting the operation of heater 11. Accordingly, the surface of heat roller 12 maintains a predetermined temperature. If thermal sensor 17 fails to operate due to a malfunction, heat roller 12 is continuously heated. As a result, supporting frame 14 which supports heat roller 12 will soften and eventually melt. For this reason, thermal fuse 16 is positioned such that heat roller 12 is displaced in a direction towards thermal fuse 16 from the force exerted by pressure roller 10 when supporting frame 14 softens or melts, or when a recording sheet passes between heat roller 12 and pressure roller 10. Accordingly, heat roller 12 is moved towards thermal fuse 16 each time a recording sheet passes between heat roller 12 and pressure roller 10, or when supporting frame 14 softens or melts. This configuration enables thermal fuse 16 to better monitor the condition of heat roller 12. If the temperature of heat roller 12 exceeds a predetermined level, thermal fuse 16 is cut off as a result of the heat, and the electrical power provided to heating means 11 is interrupted. Although the fixing means in the preferred embodiment of the present invention comprises heating means 11, heat roller 12 and pressure roller 10, it is contemplated that another construction for the fixing unit may be used in the practice of the present invention.

As described above, the present invention provides a thermal fuse positioned such that the heat roller is displaced in a direction towards the thermal fuse from the force exerted by the pressure roller when the supporting frame softens or melts, and as a recording sheet passes between the heat roller and the pressure roller. Therefore, since the distance between the heat roller and the thermal fuse is reduced, an overheated state of the fixing unit can be responded to more quickly and damage to the electrophotographic system can be prevented.

While there have been illustrated and described what are considered to be preferred embodiments of the present invention, it will be understood by those skilled in the art that various changes and modifications may be made, and equivalents may be substituted for elements thereof without departing from the true scope of the present invention. In addition, many modifications may be made to adapt a particular situation to the teaching of the present invention without departing from the central scope thereof. Therefore, it is intended that the present invention not be limited to the particular embodiments disclosed as the best mode contemplated for carrying out the present invention, but that the present invention includes all embodiments falling within the scope of the appended claims.

What is claimed is:

1. A device for preventing a fixing unit from overheating in an electrophotographic system, said device comprising:

a heat roller assembly comprising a shaft and a bearing supporting a heat roller, providing an exterior circumferential surface oriented to transfer heat to printable media passing against said exterior circumferential surface;

a housing surrounding said heat roller;

heating means positioned within an interior portion of said heat roller for converting electrical power into said heat;

a frame made of a material that begins to exhibit thermal deformation at ambient temperatures above a first temperature, engaging said housing and supporting said bearing and said heat roller spaced-apart from said housing and thermally deforming in response to increase in said temperature exhibited by said heat roller before deformation of said heat roller assemble;

thermal sensing means formed on one side of said frame and contacting a surface of said heat roller, for controlling generation of said heat by said heating means to maintain said exterior circumferential surface at external temperatures lower than said first temperature;

a thermal fuse mounted on said housing and positioned on a same side of said heat roller as said frame, for interrupting flow of said electrical power to said heating means upon detecting that any temperature exhibited by said heat roller exceeds a predetermined level; and a pressure roller for applying a force tangentially along said exterior circumferential surface of said heat roller with said force and said thermal fuse being positioned on radially opposite sides of said exterior circumferential surface so that said heat roller is biased in a direction towards said thermal fuse.

2. The device as claimed in claim 1, further comprised of said frame becoming deformed while enabling said pressure roller to displace said heat roller in said direction towards said thermal fuse when said external temperatures exhibited by said heat roller exceed said predetermined level.

3. A fixing unit for an electrophotographic system, comprising:

a heat roller assembly comprising a shaft and a bearing supporting one end of said heat roller;

first means positioned within an interior portion of said heat roller for generating heat to increase a temperature exhibited by said heat roller;

second means for interrupting electrical power to said first means upon detecting that said temperature exhibited by said heat roller exceeds a predetermined level;

third means for applying a force upon said heat roller so that said heat roller is biased in a direction towards said second means; and a frame located between said bearing and said second means for positioning said bearing said frame becoming deformed in response to increase in said temperature exhibited by said heat roller before deformation of said heat roller assembly and enabling said third means to displace said heat roller in said direction towards said second means.

4. The fixing unit as claimed in claim 3, wherein said first means comprises a heat lamp.

5. The fixing unit as claimed in claim 3, wherein said second means comprises a thermal fuse.

6. The fixing unit as claimed in claim 5, wherein said third means comprises a pressure roller.

7. The fixing unit as claimed in claim 6, further comprising fourth means for contacting a surface of said heat roller to control the temperature exhibited by said heat roller.

8. The fixing unit as claimed in claim 7, wherein said fourth means comprises a thermal sensor.

9. The fixing unit as claimed in claim 3, wherein said second means comprises a thermal fuse.

10. The fixing unit as claimed in claim 3, wherein said third means comprises a pressure roller.

11. The fixing unit as claimed in claim 3, further comprising fourth means for contacting a surface of said heat roller to control the temperature exhibited by said heat roller.

12. The fixing unit as claimed in claim 11, wherein said fourth means comprises a thermal sensor.

13. The fixing unit as claimed in claim 3, further comprising a supporting frame for supporting said heat roller, said supporting frame becoming deformed and enabling said third means to displace said heat roller in the direction towards said second means when the temperature exhibited by said heat roller exceeds the predetermined level.

14. A method for preventing a fixing unit from overheating in an electrophotographic system, comprising:

applying a force upon a heat roller assembly comprising a shaft and a bearing supporting a heat roller so that said heat roller is biased in a direction towards a thermal fuse;

detecting, via said thermal fuse, when a temperature exhibited by said heat roller exceeds a predetermined level after a frame engaging a bearing supporting said heat roller becomes deformed before deformation of said heat roller assembly as said temperature exhibited by said heat roller exceeds a predetermined level; and interrupting electrical power to a heating source of said heat roller when said thermal fuse detects that said temperature exhibited by said heat roller exceeds said predetermined level.

15. The method as claimed in claim 14, wherein said heating source of said heat roller comprises a heating lamp installed within an interior of said heat roller.

16. The method as claimed in claim 14, further comprised of enabling a frame that supports said heat roller to become deformed so that said heat roller is displaced in the direction towards said thermal fuse when the temperature exhibited by said heat roller exceeds the predetermined level.

17. A fixing device for an image forming apparatus, comprising:

means for preventing a fixing unit from overheating in an electrophotographic system of said image forming apparatus by interrupting flow of electrical power in response to occurrence of an ambient temperature above a first temperature;

a heating roller assembly comprising a shaft and a bearing supporting a heating roller, said assembly converting the electrical power into heat and said heating roller providing an exterior circumferential surface oriented to transfer said heat to printable media passing against said circumferential surface while traveling through said apparatus;

a pressure roller positioned to apply force tangentially along said exterior circumferential surface of said heat roller, with said force and said preventing means being positioned on radially opposite sides of said exterior circumferential surface, and with said force biasing said heat roller in a direction towards said preventing means; and a supporting frame for supporting said heating roller assembly and enabling said heating roller to be displaced in a direction towards said preventing means when said heating roller is in an overheated condition, said frame being made of a material that begins to exhibit thermal deformation in response to increase in said ambient temperature before thermal deformation of said heating roller assembly.

18. A fixing device for an image forming apparatus, comprising:

fixing means comprised of:

a heat roller assembly comprising a shaft and a bearing supporting a heat roller; and a heat lamp for generating heat for image fixation by said heat roller;

supporting means made of a material that begins to exhibit thermal deformation at ambient temperatures above a first temperature for supporting said fixing means by contacting said bearing, said supporting means thermally deforming in response to increase in said ambient temperature above said first temperature exhibited by said heat roller before deformation of said heat roller assembly;

pressure means for biasing said fixing means towards said supporting means; and interrupting means spaced apart from said fixing means by said supporting means, for interrupting electrical power to said heating means in response to detection of an overheating condition at said fixing means, said supporting means enabling said fixing means to be moved towards said interrupting means by said pressure means when said fixing means exhibits the overheated condition and said supporting means becomes soft or melts as said fixing means exhibits said overheated condition.

* * * * *